US008357076B2

(12) United States Patent
Blank

(10) Patent No.: US 8,357,076 B2
(45) Date of Patent: Jan. 22, 2013

(54) THERAPEUTIC DEVICE AND METHOD OF USING

(76) Inventor: Mary Elizabeth Blank, Creve Coeur, IL (US)

( * ) Notice: Subject to any disclaimer, the term of this patent is extended or adjusted under 35 U.S.C. 154(b) by 0 days.

(21) Appl. No.: 12/906,088

(22) Filed: Oct. 16, 2010

(65) Prior Publication Data

US 2011/0092342 A1 Apr. 21, 2011

Related U.S. Application Data

(60) Provisional application No. 61/279,206, filed on Oct. 19, 2009.

(51) Int. Cl.
*A63B 210/00* (2006.01)

(52) U.S. Cl. ..... 482/105; 482/93; 482/124

(58) Field of Classification Search ..... 601/33, 601/34, 35; 602/33, 34, 35; 482/124, 125
See application file for complete search history.

(56) References Cited

U.S. PATENT DOCUMENTS

| | | | | |
|---|---|---|---|---|
| 4,984,786 | A * | 1/1991 | Lemke et al. | 482/105 |
| 5,286,242 | A * | 2/1994 | Johnston | 482/95 |
| 6,685,658 | B1 | 2/2004 | Dietz | |
| 7,244,238 | B2 | 7/2007 | March | |
| 7,762,963 | B2 | 7/2010 | Ewing | |

OTHER PUBLICATIONS

Website: URL: http://www.ongoingcare.com/?View=osgap.
Website: URL: http://www.cleburneorthopedics.com/physical_knee.html.

* cited by examiner

*Primary Examiner* — Jerome W Donnelly
(74) *Attorney, Agent, or Firm* — Robin Fahlberg

(57) ABSTRACT

A therapeutic device includes a weight distributing portion and a weight attaching portion. The weight distributing portion includes a relief area. The weight attaching portion is adapted to attach weights to the weight distributing portion.

19 Claims, 11 Drawing Sheets

120

136
136
124
126
126
138
140
138
118
A
B
C
D
118
L
138
140
138
A
B
C
D
122
126
126
134
134
132
130
W

THERAPEUTIC DEVICE AND METHOD OF USING

PRIORITY

This application claims priority to provisional patent application Ser. No. 61/279,206, filed Oct. 19, 2009, and entitled Comfortstretch™.

TECHNICAL FIELD

The present invention relates in general to a physical therapy device, and more particularly, to a physical therapy device to slowly stretch leg or arm muscles.

BACKGROUND

Individuals with neuromuscular diseases, such as Cerebral Palsy may experience muscular contraction which may cause reduced mobility and limited range of motion in joints such as the knee and elbow. Individuals suffering from sports injuries, other injuries to joints, and/or Arthrofibrosis, may also have a reduced range of motions in a joint. Traditional physical therapy exercises may be painful. A continuous, gentle pull of a weight to stretch a muscle while the muscles is relaxed may provide some range of motion improvement, and may be less painful.

SUMMARY OF THE INVENTION

In one aspect of the invention, a therapeutic device including a weight distributing portion and a weight attaching portion is disclosed. The weight distributing portion includes a relief area. The weight attaching portion is adapted to attach weights to the weight distributing portion.

In another aspect of the invention, a method of at least partially straightening a leg with a therapeutic device is disclosed. The leg includes a knee. The therapeutic device includes a weight distributing portion and a weight attaching portion. The weight distributing portion includes a relief area. The weight attaching portion is attached to the weight distributing portion. The method includes supporting the leg above and below a knee; placing the weight distributing portion on the leg with the relief area over the knee; and attaching weights to the weight distributing portion with the weight attaching portion.

In another aspect of the invention, a method of at least partially straightening one or both legs of a human with a therapeutic device is disclosed. Each leg includes an ankle. The therapeutic device includes a weight distributing portion and a weight attaching portion. The weight attaching portion is attached to the weight distributing portion. The method includes folding the weight distributing portion; laying the human on his/her stomach on an elevated support platform including an edge, with the one or more ankles extending over the edge; placing the folded weight distributing portion over one or both of the ankles; and attaching weights to the weight distributing portion with the weight attaching portion.

In another aspect of the invention, a method of at least partially straightening an arm of a human with a therapeutic device is disclosed. The arm includes an elbow, an upper arm, and a lower arm. The therapeutic device includes a weight distributing portion and a weight attaching portion. The weight attachment portion is attached to the weight distributing portion. The method includes folding the weight distributing portion; supporting the elbow on a surface; placing the folded weight distributing portion over a portion of the lower arm; and attaching weights to the weight distributing portion with the weight attaching portion.

In another aspect of the invention, a method of bending one or both legs of a human with a therapeutic device is disclosed. Each leg includes an ankle and a foot. The therapeutic device includes a weight distributing portion and a weight attaching portion. The weight attaching portion is attached to the weight distributing portion. The method includes folding the weight distributing portion; laying the human on his/her back on a first support surface; placing one or both feet against a second support surface substantially perpendicular to the first support surface; placing the folded weight distributing portion over one or both of the ankles; and attaching weights to the weight distributing portion with the weight attaching portion.

DETAILED DESCRIPTION

Therapeutic Device

Reference will now be made in detail to specific embodiments or features, examples of which are illustrated in the accompanying drawings. Generally, corresponding reference numbers will be used throughout the drawings to refer to the same or corresponding parts.

Figure 1:
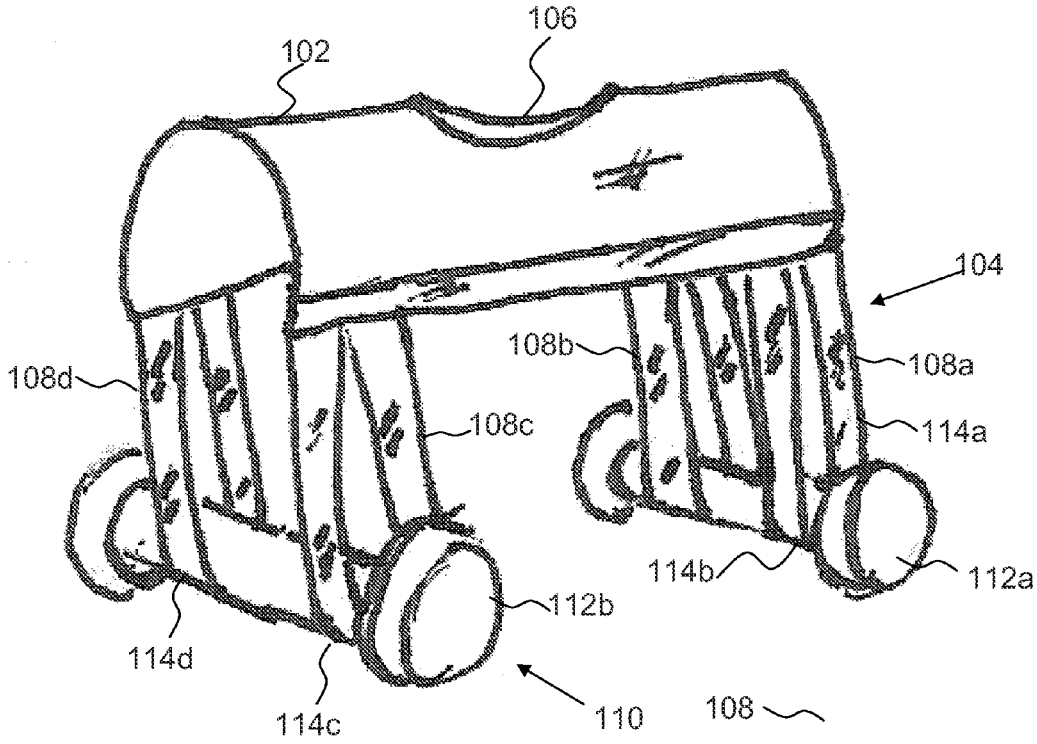
FIG. 1 depicts a first exemplary embodiment of a therapeutic device including one or more hand weights.

Referring now to FIG. 1, an exemplary embodiment of a therapeutic device 100 is depicted with weight 110. The therapeutic device 100 includes a weight distributing portion 102 and a weight attaching portion 104. The weight distributing portion 102 includes a relief area 106. The weight attaching portion 104 is adapted to attach weight 110 to the weight distributing portion 102.

In the depicted embodiment, the weight attaching portion includes straps 108. Straps 108 includes four straps 108*a*, 108*b*, 108*c*, 108*d*. The straps 108 include loops 114. Loops 114 includes four loops 114*a*, 114*h*, 114*c*, 114*d*. The weight 110 includes hand weights 112. Hand weights 112 includes two hand weights 112*a*, 112*b* which are attached to the weight distributing portion 102 by being placed into loops 114.

Figure 4:
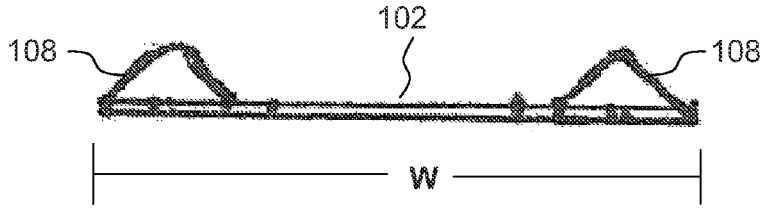
FIG. 4 depicts the first exemplary embodiment of a therapeutic device from another perspective.
Figure 2:
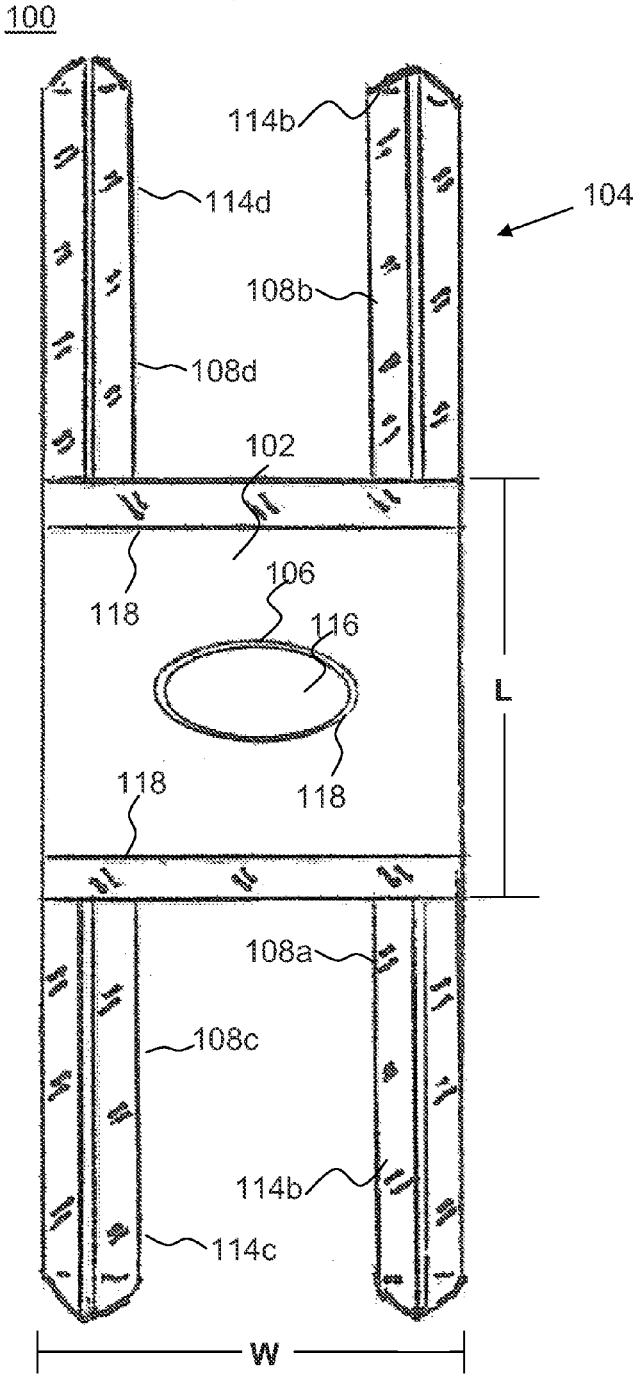
FIG. 2 depicts the first exemplary embodiment of a therapeutic device from another perspective.
Figure 3:
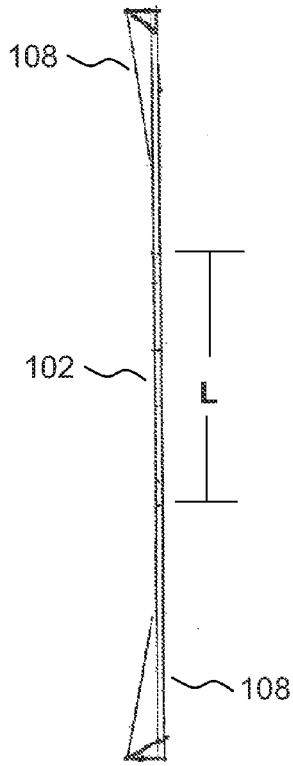
FIG. 3 depicts the first exemplary embodiment of a therapeutic device from another perspective.

Referring now to FIGS. 2-4, three views of an exemplary embodiment of the therapeutic device 100 from different perspectives are shown in the embodiment depicted, the weight distributing portion 102 is substantially rectangularly shaped and includes a length L, and a width W. The corners of the weight distributing portion 102 in the depicted embodiment are square, however, in alternative embodiments the corners may be rounded or in any shape that would be known in the art. The weight distributing portion 102 may include a top side and a bottom side.

Figure 8:
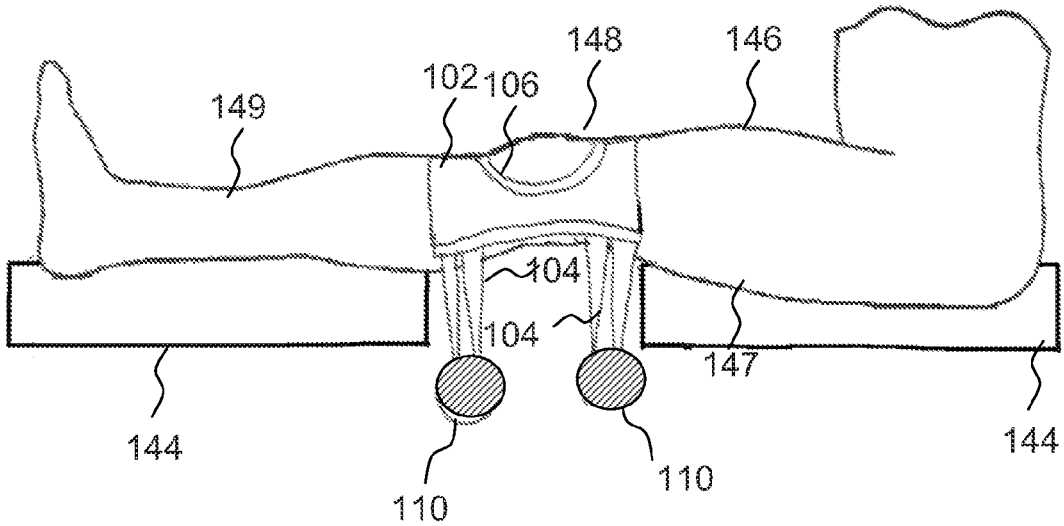
FIG. 8 depicts an exemplary method of using a therapeutic device.

The weight distributing portion 102 includes a relief area 106. As depicted in FIG. 8, the weight distributing portion 102 is adapted to drape over a human leg 146; the leg 146 including a knee 148, upper leg 147, and lower leg 149; with the relief area 106 around the knee 148. The weight distributing portion 102 is adapted to distribute weight 110 between the upper leg 147 and the lower leg 149 such that the leg 146 at least partially straightens when weight 110 is attached to the weight distributing portion 102 by the weight attaching portion 104.

in the depicted embodiment, the relief area 106 include an aperture 116. The aperture 116 may protect the knee 148 and specifically the patella from the weight 110 being applied. The aperture 116 may be a substantially oval shape. In other embodiments the aperture may be round, elliptical, or any shape known in the art to protect the knee 148 from excessive pressure. In an alternative embodiment, the relief area 106 may include a different fabric or material which is more flexible than other material in the weight distributing portion 102. In another embodiment the relief area may include a puffed out shape which would not rest on the knee 148. In other embodiment the relief area 106 may include any configuration that an ordinary person skilled in the art now or in the future would know to relieve excessive pressure on the knee 148 while the weight 110 is distributed to the upper leg 147 and lower leg 149.

The weight distributing portion 102 may include a flexible sheet material, such canvas or other cotton or polyester blend fabric. In other embodiments, the weight distributing portion 102 may include plastic, synthetics or any other flexible sheet material that would be known by an ordinary person skilled in the art now or in the future.

In a method of making an embodiment of the weight distributing portion 102, a first rectangular piece of canvas material may be cut with round or square corners. A second rectangular piece of lining fabric may be cut slightly larger than the first rectangular piece. The first and second pieces may be sewn, right sides together on both of the length ends, making sure that the excess lining extends evenly along the edges on the width side of the weight distributing portion 102. The first and second pieces may then be turned so the edges of the seams do not show as is known in the art. The seams and the weight distributing portion 102 may then be pressed. Excess lining fabric on the width sides may then be turned up over the raw edge of the length side of the first rectangular piece and pressed. All four sides of the weight distributing portion 102 may then be top stitched. The desired location of the aperture 116 may then be marked on the first rectangular piece. The desired location of the aperture 116 may be in the center of the first rectangular piece. A single row of stitching may be made around the aperture 116 marking. The aperture 116 may then be cut in both the first rectangular piece and the second rectangular piece of lining fabric. The edge of the aperture 116 may be finished off with reinforcement material 118. The reinforcement material 118 may include single fold knit ribbing or any other reinforcement material 118 known in the art.

In another method of making an embodiment of the weight distributing portion 102, a first rectangular piece of canvas material with an aperture 116 may be cut with round or square corners. A second piece of lining fabric may be cut slightly larger than the first rectangular piece. The first and second piece may be sewn, right sides together, turned and top stitched. A single row of stitching may be made around the aperture and the second piece of material may then be cut out to match the aperture 116 in the first piece of fabric. The edge of the aperture 116 may be finished off with reinforcement material 118. The reinforcement material 118 may include single fold knit ribbing or any other reinforcement material 118 known in the art.

The weight distributing portion 102 may be made by any method that would be known to a person skilled in the art now or in the future.

The weight distributing portion 102 may include reinforcement material 118 along edges. The reinforcement material 118 may reduce wear, provide additional stability, and aid in ensuring that weight 110 is distributed well. The reinforcement material 118 along edges may include strips of polyester webbing. In other embodiments the reinforcement material 118 may include one or more rows of stitching, other reinforcement material 118 known in the art, or a combination of reinforcement materials 118.

The weight attaching portion 104 attaches weight 110 to the weight distributing portion 102 such that when the weight attaching portion 104 is draped over a leg 146 with the relief area 106 over the knee 148, the weight 110 is distributed such that the leg 146 is at least partially straightened. In the depicted embodiment, the weight distributing portion 104 includes straps 108. The straps 108 may include four straps 108*a*, 108*b*, 108*c*, 108*d*. The straps 108 may be attached to the weight distributing portion 102 at four locations in a manner that the straps 108 form loops 114. In the depicted embodiment, where the weight distributing portion 102 is substantially rectangularly shaped, the straps 108 may be attached to form loops 114 at the four corners of the weight distributing portion 102. The loops may be adapted for hand weights 112 to be placed in them.

The straps 108 may include four strips of polyester webbing. In other embodiments the straps 108 may include any material which could be adapted to attach weight 110 to weight distributing portion 102, as would be known by an ordinary person skilled in the art now or in the future. The straps 108 may be approximately one inch in width.

In some embodiments, the straps 108 may be sewn on the top side of the weight distributing portion 102. In some embodiments the straps may be sewn on the width sides of the weight distributing portion 102 five eighths of an inch from the edge. The length of the straps 108 may vary with the size of the weight distributing portion 102 and the weight 110. Reinforcement material 118 may be sewn along width edge of the weight distributing portion to cover the ends of the loops. The reinforcement material 118 may also add stability to both sides.

Figure 5:
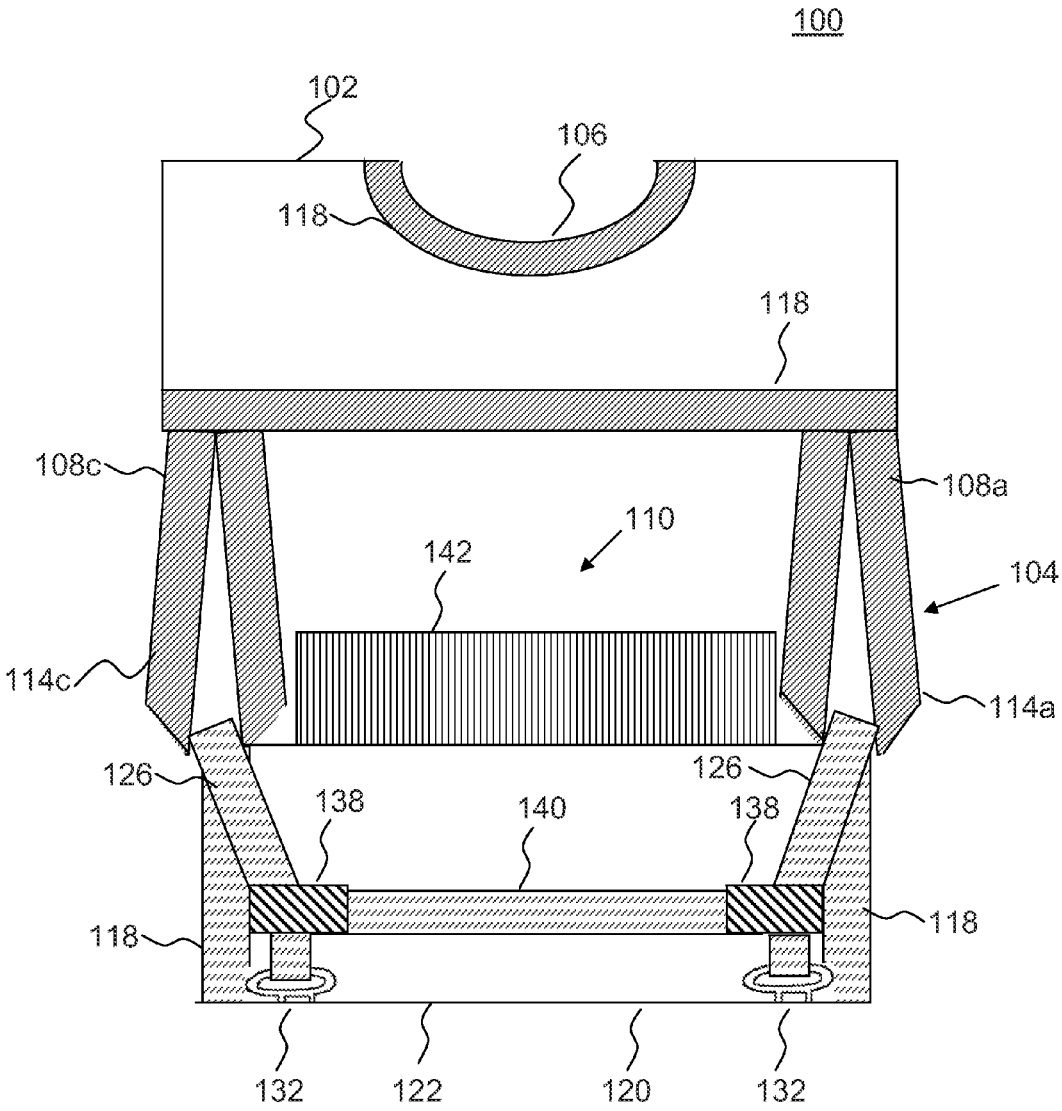
FIG. 5 depicts a second exemplary embodiment of a therapeutic device including a cradle.

Referring now to FIG. 5, another exemplary embodiment of a therapeutic device 100 is shown. The therapeutic device 100 includes a weight distributing portion 102 with a relief area 106 and a weight attachment portion 104. In the embodiment depicted, the weight distributing portion 102 is as described in relation to FIGS. 1-4 above.

In the depicted embodiment, the weight attachment portion 104 includes a cradle 120 which holds weight 110. The weight attachment portion may include straps 108, including four straps 108*a*, 108*b*, 108*c*, 108*d*, and four loops 114*a*, 114*b*, 114*c*, 114*d*. The straps 108 may attach the cradle 120 to the weight distributing portion 102. The weight 110 may include an object 142. The object 142 may include a can of food, a bag of sugar or flour, a brick, a stone, or any other object 142 which will provide weight 110 to partially straighten a leg 148 when attached to the weight distributing portion 102 as would be known by an ordinary person skilled in the art now or in the future.

Figure 6:
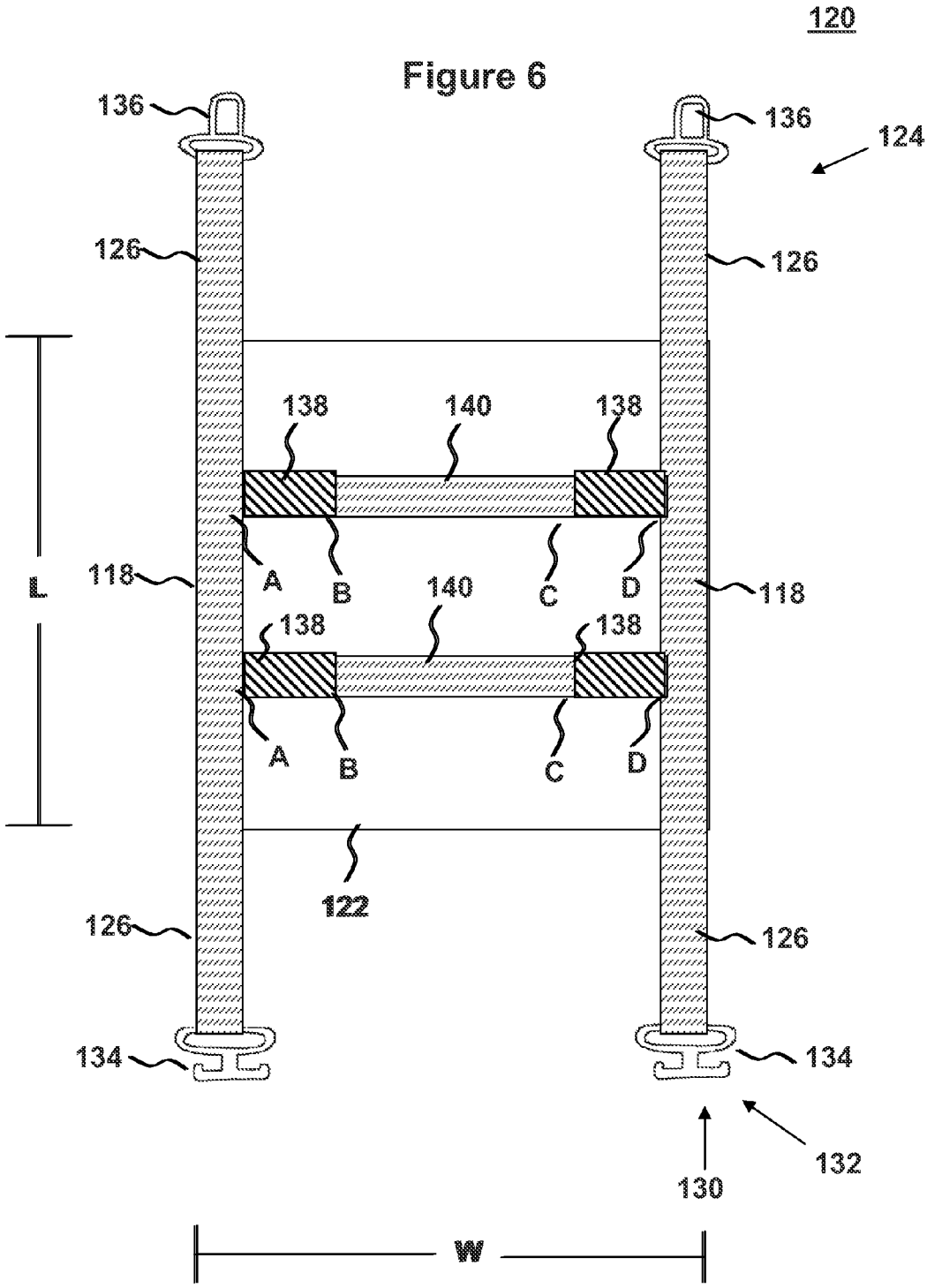
FIG. 6 depicts an exemplary embodiment of a cradle.
Figure 7:
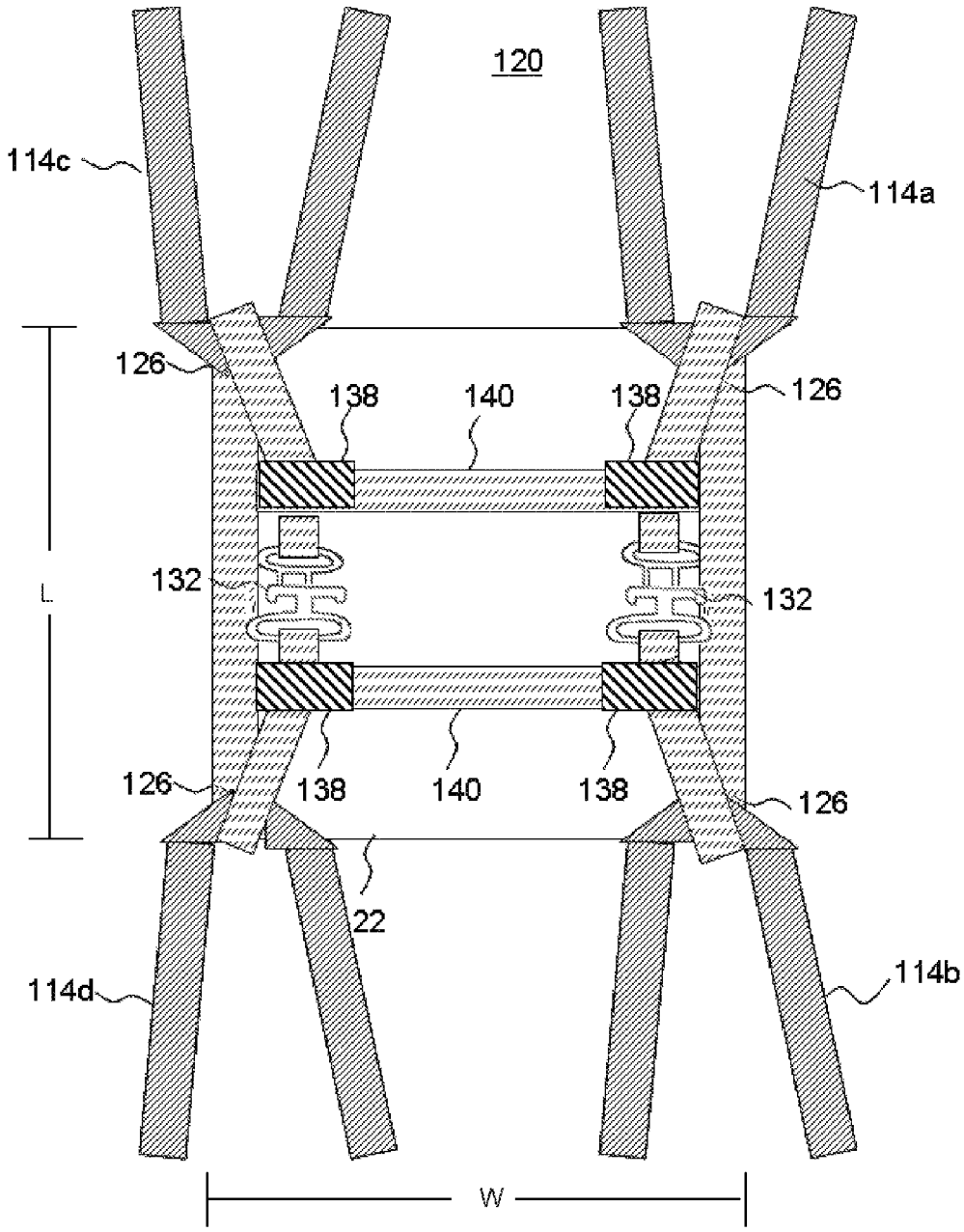
FIG. 7 depicts the cradle depicted in FIG. 6 with attaching straps.

Referring now to FIGS. 6 and 7, an exemplary embodiment of a cradle 120 is shown. The cradle 120 may include a weight holding portion 122 and a cradle attachment assembly 124.

The weight holding portion 122 is adapted to hold weight 110. The weight holding portion 122 depicted is substantially rectangularly shaped and includes a length L and a width W. In the depicted embodiment, the weight holding portion 122 is adapted to be folded along the width (halving the length) and to form a pocket open on two sides when attached to the weight distributing portion 102. In other embodiments, the weight holding portion 122 may be pocket shaped and only open on the top, basket shaped, cylindrically shaped, or shaped in any form which would be adaptable to hold weight 110 as would be known by an ordinary person skilled in the art now or in the future.

The weight holding portion 122 may include reinforcement material 118 along the 2 length sides. The weight holding portion 122 may include one or more holding strips 140 which form holders 138 as will be explained below.

The weight holding portion 122 may include a flexible sheet material, such canvas, or other cotton or polyester blend fabric. In other embodiments, the weight distributing portion 102 may include plastic, synthetics or any other flexible sheet material that would be known by an ordinary person skilled in the art now or in the future.

The cradle attachment assembly 124 may include cradle straps 126 and fasteners 130 for attaching the weight holding portion to the loops 114. The reinforcement material 118 and the cradle straps 126 may be formed by two strips of polyester webbing sewn to the weight holding portion 122. In other embodiments the cradle straps 126 may include any material that would attach the weight holding portion 122 to loops 114 with fasteners 130 as would be known by an ordinary person skilled in the art now or in the future.

In other embodiments the reinforcement material 118 may include one or more rows of stitching or a combination of reinforcement materials 118. The reinforcement material 118 may include any material which would be known by an ordinary person skilled in the art now or in the future to reinforce the edges of the weight distributing portion 122.

The fasteners 130 may include clasps 132. The clasps 132 may include a hook 134 and loop 136 which fasten together as is known in the art. In other embodiments the fasteners 130 may include hook and loop material including Velcro™, buttons and button holes, snaps, or any other fasteners that would be known by an ordinary person skilled in the art now or in the future. The hooks 134 may be attached to the cradle straps 126 on one end of the weight holding portion 122, and the loops 136 may be attached to the cradle straps 126 on the other end of the weight holding portion 122.

As shown in FIG. 7, the cradle straps 126 may be inserted into the loops 114, folded over, and put through the holders 138. The fasteners 130 may then be fastened securing the cradle 120 to the weight distributing portion 102. Any object 142 may then be placed in the cradle 120 to provide weight 110.

in a method of making an embodiment of the cradle 120, a first rectangular piece of canvas material may be cut with round or square corners. A second rectangular piece of lining fabric may be cut slightly larger than the first rectangular piece. The first and second pieces may be sewn, right sides together on both of the width ends, making sure that the excess lining extends evenly along the edges on the length side of the weight holding portion 122. The first and second pieces may then be turned so the edges of the seams do not show as is known in the art. The seams and the weight holding portion 122 may then be pressed. Excess lining fabric on the length sides may then be turned up over the raw edge of the width side of the first rectangular piece and pressed. All four sides of the weight holding portion 122 may then be top stitched. Two strips of polyester webbing may then be sewn on to the weight holding portion 122 to form two holding strips 140 and four holders 138. A strip of polyester webbing, longer than the length of the weight holding portion 122 may be centered and sewn on both length sides of the weight holding portion to form for cradle straps 126 and reinforcement material 118.

Methods of Using Therapeutic Device

Figure 12:
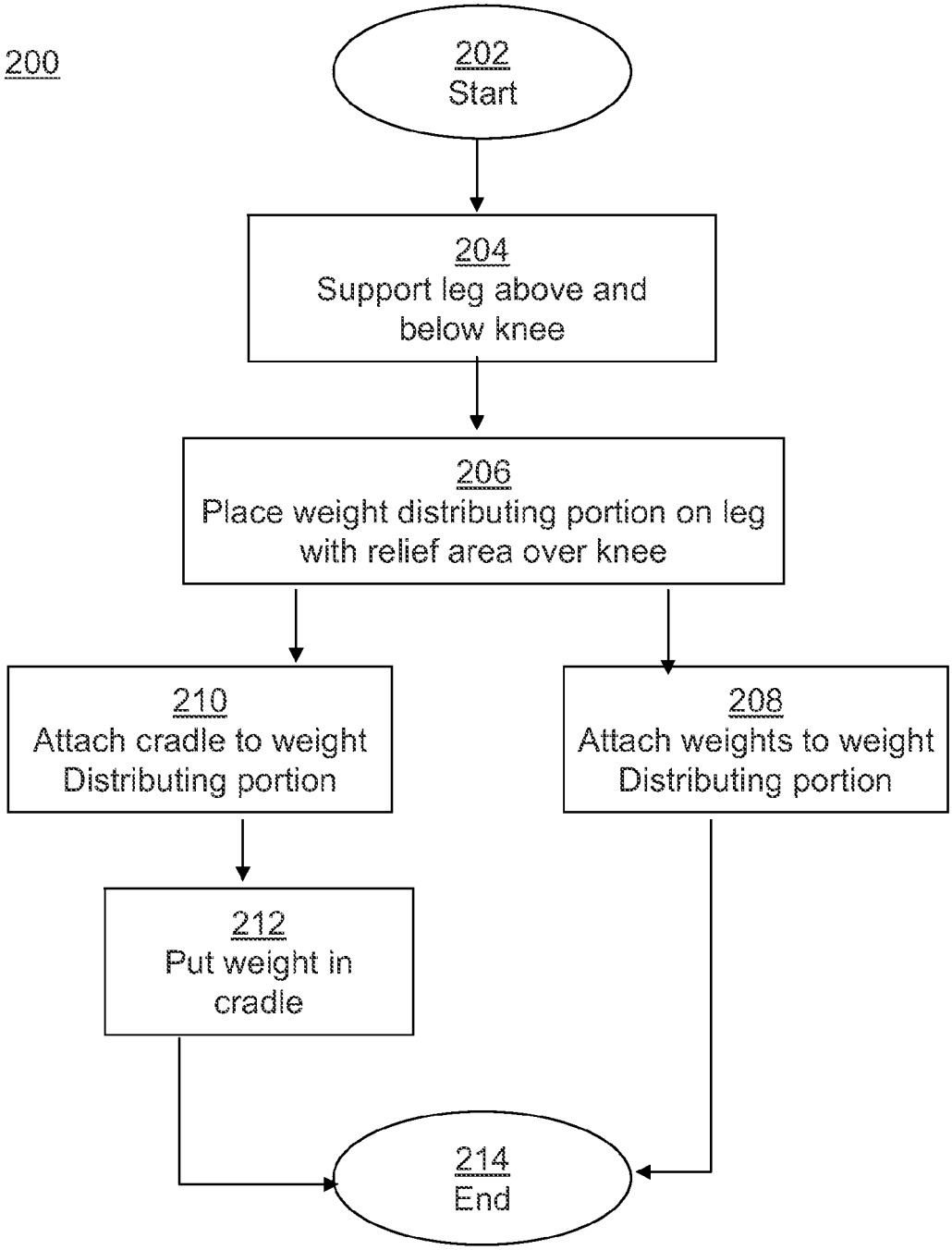
FIG. 12 is a flow chart of an exemplary method of at least partially straightening a leg with a therapeutic device.

Referring now to FIGS. 8 and 12, a method 200 for at least partially straightening a leg 146 with a therapeutic device 100 is depicted. The leg 146 includes a knee 148. The therapeutic device 100 includes a weight distributing portion 102 including a relief area 106, and a weight attaching portion 104 attached to the weight distributing portion 102.

The method 200 starts at step 202. The method 200 then proceeds to step 204.

At step 204 the leg 146 is supported above and below the knee 148. A support platform 144 may support the upper leg 147. Another support platform may support the lower leg 149. For example, a person may sit on a chair and put their tower leg 149 on a stool. The chair supports their upper leg 147. The stool supports their lower leg 149. In another example a person may sit in a recliner with a built in foot/leg support such as a Lazyboy™. The chair supports the upper leg 149 and the foot/leg support supports the lower leg 149.

At step 206 the weight distributing portion 102 is placed on the leg 146 with the relief area 106 over the knee 148. The relief area 106 prevents excessive pressure from being exerted on the patella of the knee 148. The method 200 then proceeds to step 208 or step 210.

At step 208, weight 110 is attached to the weight distributing portion 102 with the weight attaching portion 104. In one example the weight attaching portion 104 includes straps 108 with loops 114. The straps 108 with loops 114 may extend down both above and below the knee 148. One or more hand weights 112 may be placed in the loops 114. The size of the hand weights 112 may be selected to address each individual person's needs.

The weight 110 may cause the weight distributing portion 102 to apply pressure above and below the knee 148 which may at least partially straighten the leg 146. The weight distributing portion 102 when attached to the weight 110 may create a continuous, gentle pull in the hamstring of the leg 146 which may facilitate stretching of the hamstring. The method 200 may then proceed to the end at step 214.

At step 210, cradle 120 is attached to the weight distributing portion 102. One method of attaching the cradle 120 is described above in relation to FIGS. 5-7. The method 200 may then proceeds to step 212.

At step 212, weight 110 may be put in the cradle 120. Weight 110 may include an object 142. The object 142 my include canned food, a bag of sugar or flour, a brick, a stone, a weight of some type, or any other object 142 with a weight that facilitates the correct stretch for a person. The weight 110 may cause the weight distributing portion 102 to apply pressure above and below the knee 148 which may at least partially straighten the leg 146. The weight distributing portion 102 when attached to the weight 110 may create a continuous, gentle pull in the hamstring of the leg 146 which may facilitate stretching of the hamstring. The method 200 may then proceed to the end at step 214.

Figure 10:
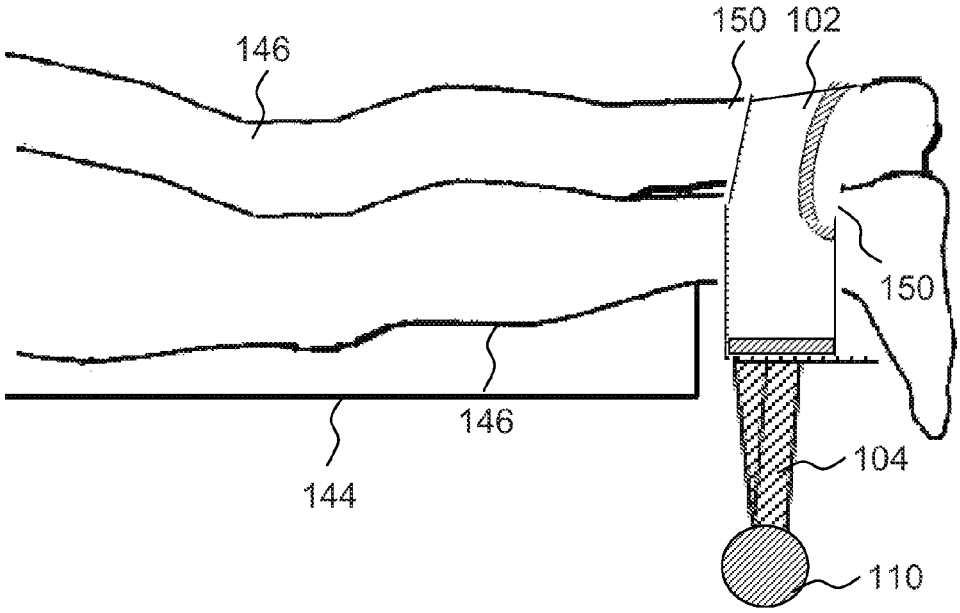
FIG. 10 depicts another exemplary method of using a therapeutic device.
Figure 13:
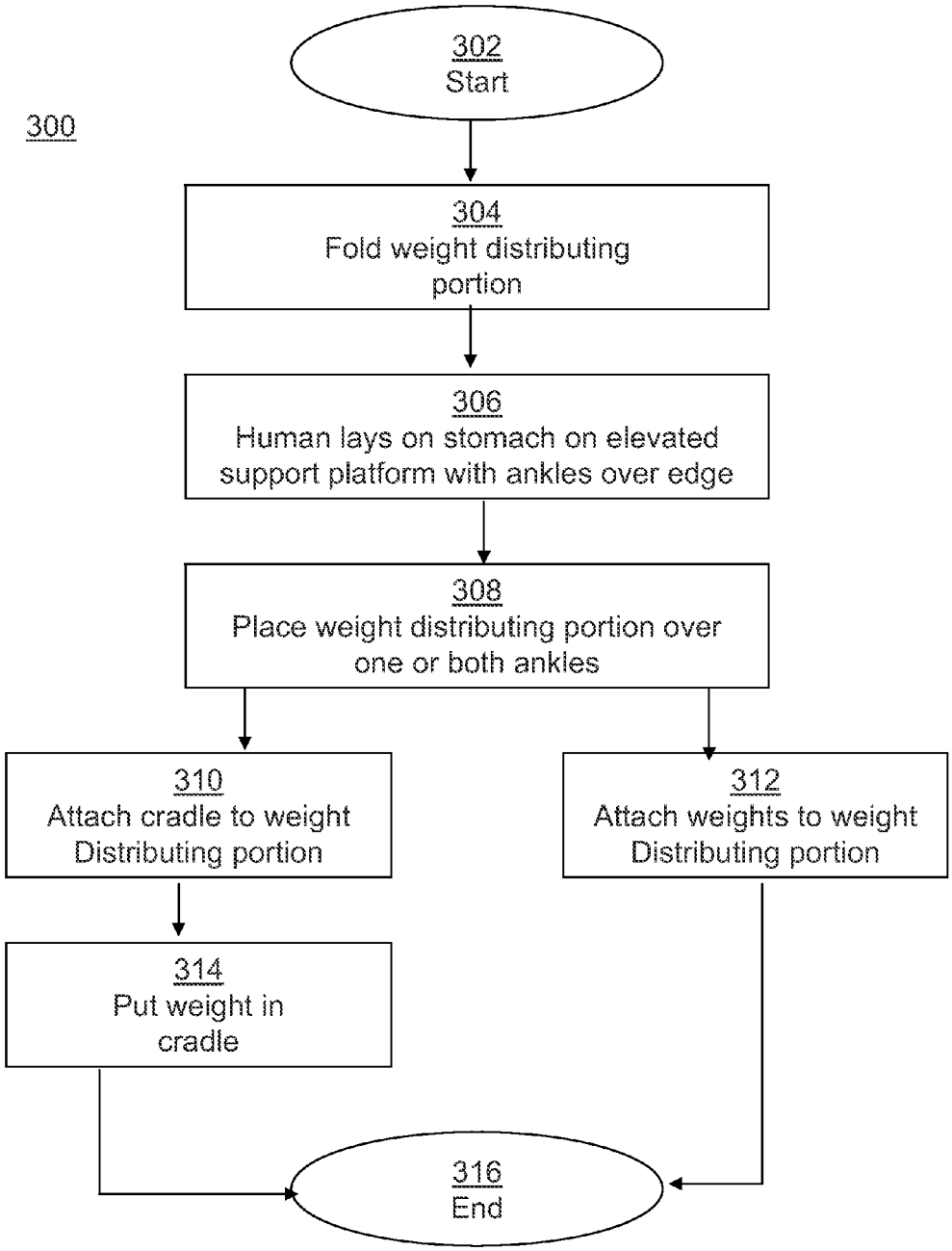
FIG. 13 is a flow chart of another exemplary method of at least partially straightening a leg with a therapeutic device.

Referring now to FIGS. 10 and 13, a method 300 for at least partially straightening one or both legs 146 of a human with a therapeutic device 100 is depicted. Each one or both legs 146 includes an ankle 150. The therapeutic device 100 includes a weight distributing portion 102 including a relief area 106, and a weight attaching portion 104 attached to the weight distributing portion 102.

The method 300 starts at step 302. The method 300 then proceeds to step 304.

At step 304, the weight distributing portion 102 is folded lengthwise. The method 300 proceeds to step 306.

At step 306, a human lies on a support platform 144, on their stomach with their ankles 150 hanging over an edge of the support platform. The method 300 then proceeds to step 308.

At step 308, the weight distributing portion 102 is placed over one or both ankles 150. The straps 108 with loops 114 may hang over the sides of one or both ankles 150. The method 300 then proceeds to step 310 or step 312.

At step 310, a cradle 120 is attached to the weight distributing portion 102. In this exemplary method 300 embodiment, a correctly sized cradle 120, as would be known by someone skilled in the art may be used. The method 300 then proceeds to step 314.

At step 314, weight 110 may be put in the cradle 120. Weight 110 may include an object 142. The object 142 may include canned food, a bag of sugar or flour, a brick, a stone, a weight of some type, or any other object 142 with a weight that facilitates the correct stretch for a person. The weight 110 may cause the weight distributing portion 102 to apply pressure pushing the ankles 150 downward and at least partially straightening one or both legs 146. The weight distributing portion 102 when attached to the weight 110 may create a continuous, gentle pull in the hamstring of the leg which may facilitate stretching of the hamstring. The method 300 may then proceed to the end at step 316.

At step 312, weight 110 is attached to the weight distributing portion 102 with the weight attaching portion 104. In one example the weight attaching portion 104 includes straps 108 with loops 114. The straps 108 with loops 114 may extend down on both sides of the one or more ankles 150. A hand weight 112 may be placed in the loops 114. The size of the hand weight 112 may be selected to address each individual person's needs.

The weight 110 may cause the weight distributing portion 102 to apply downward pressure on the one or both ankles 150 which may at least partially straighten the leg 146. The weight distributing portion 102 when attached to the weight 110 may create a continuous, gentle pull in the hamstring of the one or both legs 146 which may facilitate stretching of the hamstring. The method 300 may then proceed to the end at step 316.

Figure 11:
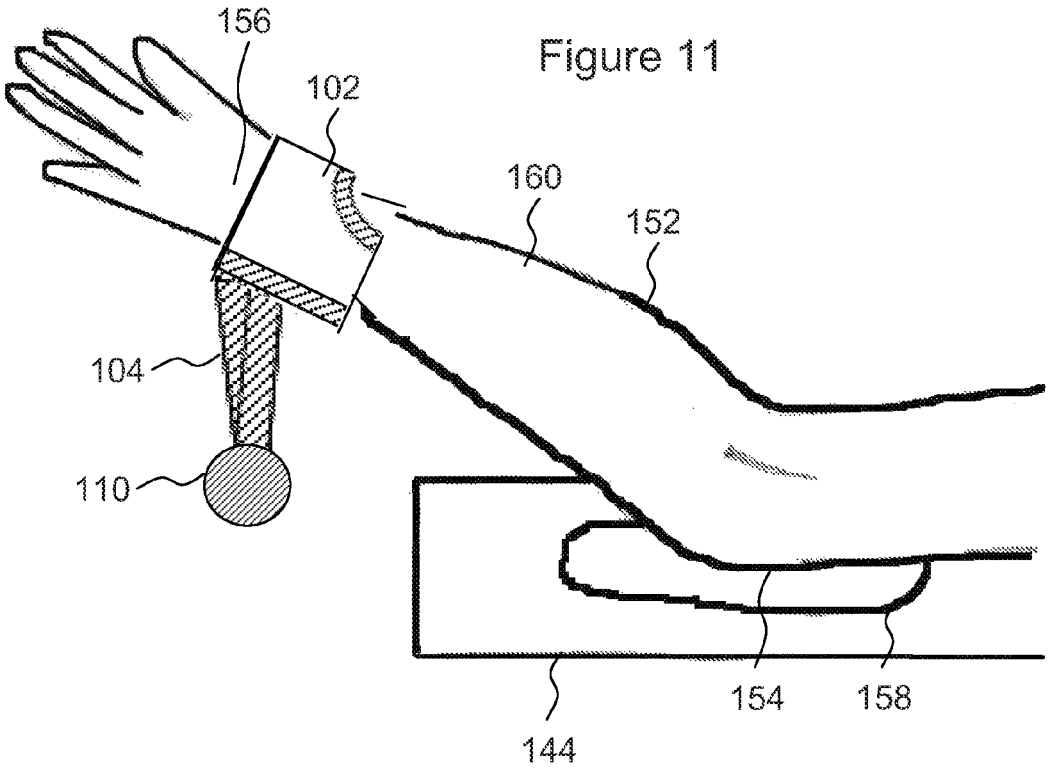
FIG. 11 depicts another exemplary method of using a therapeutic device.
Figure 14:
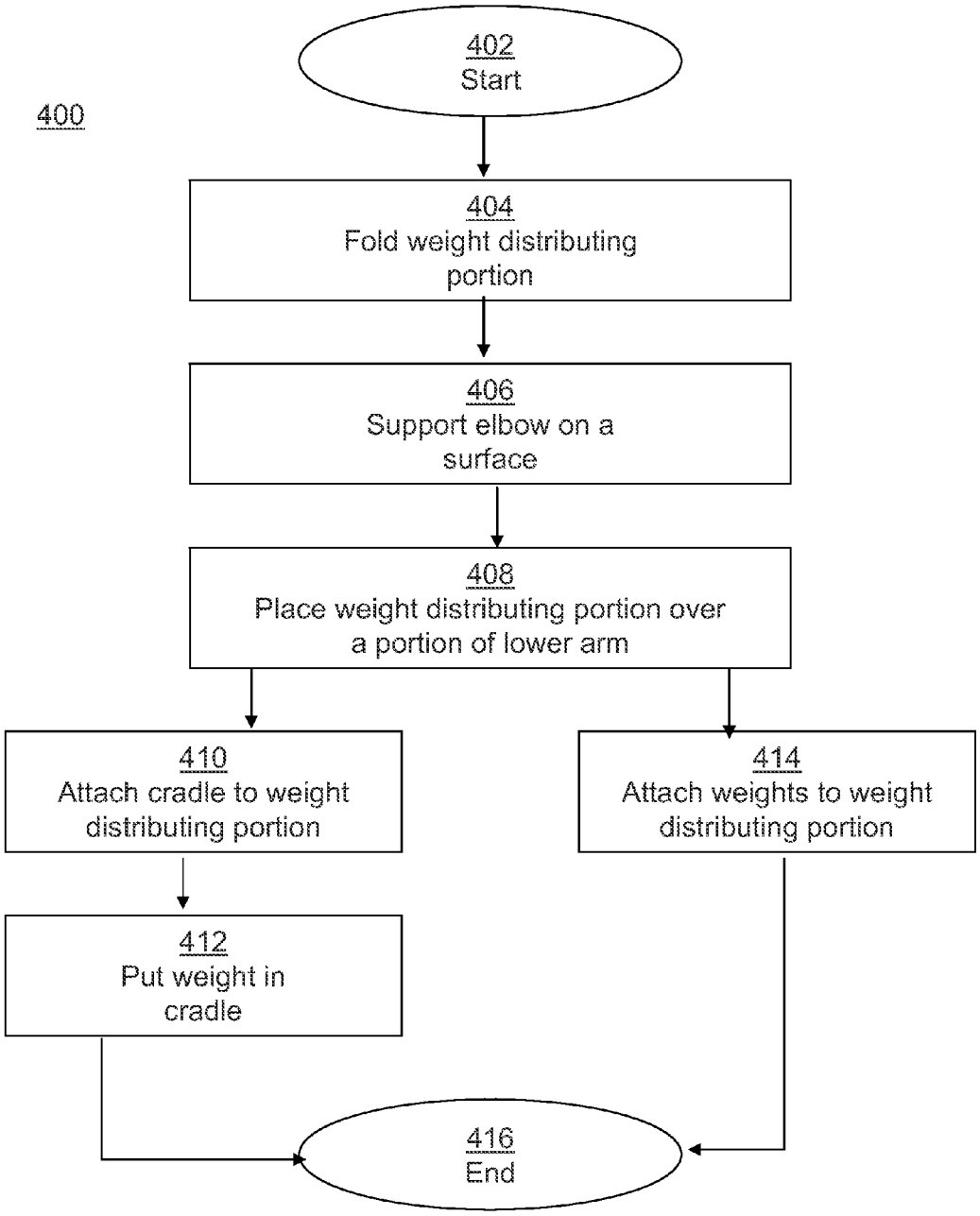
FIG. 14 is a flow chart of an exemplary method of at least partially straightening an arm with a therapeutic device.

Referring now to FIGS. 11 and 14, a method 400 for at least partially straightening an arm 152 with a therapeutic device 100 is depicted. The arm 152 includes an elbow 154, a wrist 156, and a lower arm 160. The therapeutic device 100 includes a weight distributing portion 102 including a relief area 106, and a weight attaching portion 104 attached to the weight distributing portion 102.

The method 400 starts at step 402. The method 400 then proceeds to step 404.

At step 404, the weight distributing portion 102 is folded in half lengthwise. The method 400 proceeds to step 406.

At step 406, the elbow 154 is supported on a support platform 144. The support platform 144 may for example include a counter-top, a table-top, a desk-top, or any other support platform as would be known by an ordinary person skilled in the art now or in the future. It may be beneficial, but is not necessary, to have a cushion 158, such as a folded towel or a pillow, between the support platform 144 and the elbow 154 to provide comfort for the person.

At step 408, the weight distributing portion 102 is placed on a portion of the lower arm 160. In one embodiment, the weight distributing portion 102 may be placed over the wrist 156. The straps 108 with loops 114 may hang over the sides of the arm 152. The method 400 then proceeds to step 410 or step 412.

At step 410, a cradle 120 is attached to the weight distributing portion 102. In this method 400 embodiment, a correctly sized cradle 120, as would be known by someone skilled in the art may be used. The method 400 then proceeds to step 412.

At step 412, weight 110 may be placed in the cradle 120. Weight 110 may include an object 142. The object 142 may include canned food, a bag of sugar or flour, a brick, a stone, a weight of some type, or any other object 142 with a weight that facilitates the correct stretch for a person. The weight 110 may cause the weight distributing portion 102 to apply downward pressure pushing the lower arm 160 downward and at least partially straightening the arm 152. The method 400 then proceeds to the end at step 416.

At step 414, weight 110 is attached to the weight distributing portion 102 with the weight attaching portion 104. In one example the weight attaching portion 104 includes straps 108 with loops 114. The straps 108 with loops 114 may extend down both on both sides of the lower arm 160. A hand weight 112 may be placed in the loops 114. The size of the hand weight 112 may be selected to address each individual person's needs.

The weight 110 may cause the weight distributing portion 102 to apply downward pressure on the lower arm 160 which may at least partially straighten the arm 152. The method 400 then proceeds to the end at step 416.

Figure 9:
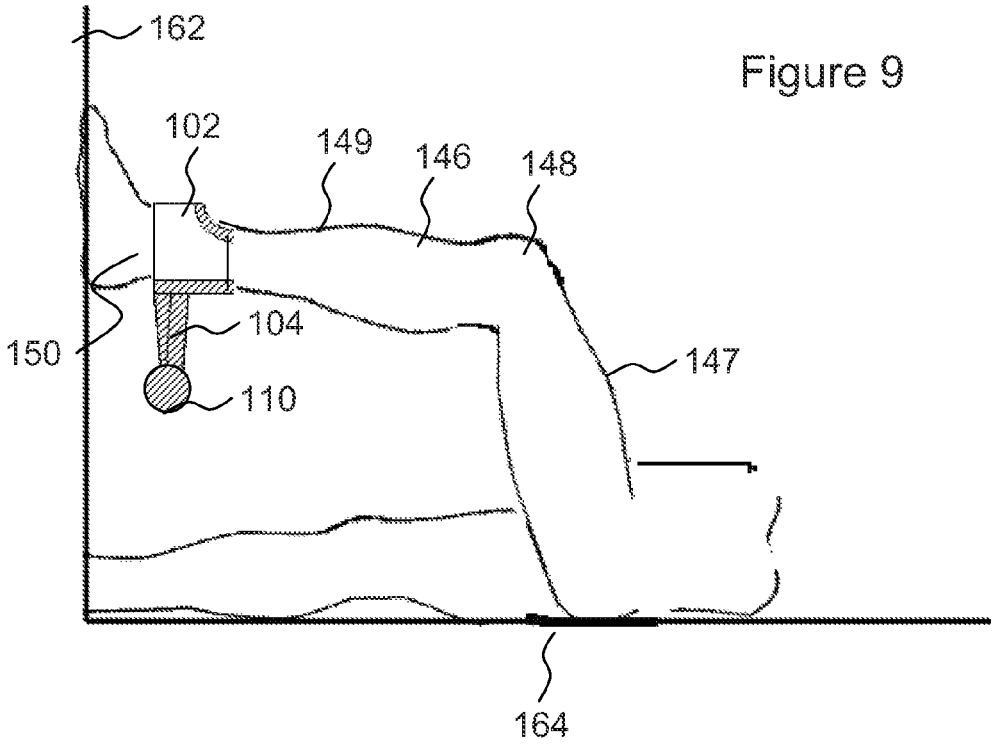
FIG. 9 depicts another exemplary method of using a therapeutic device.
Figure 15:
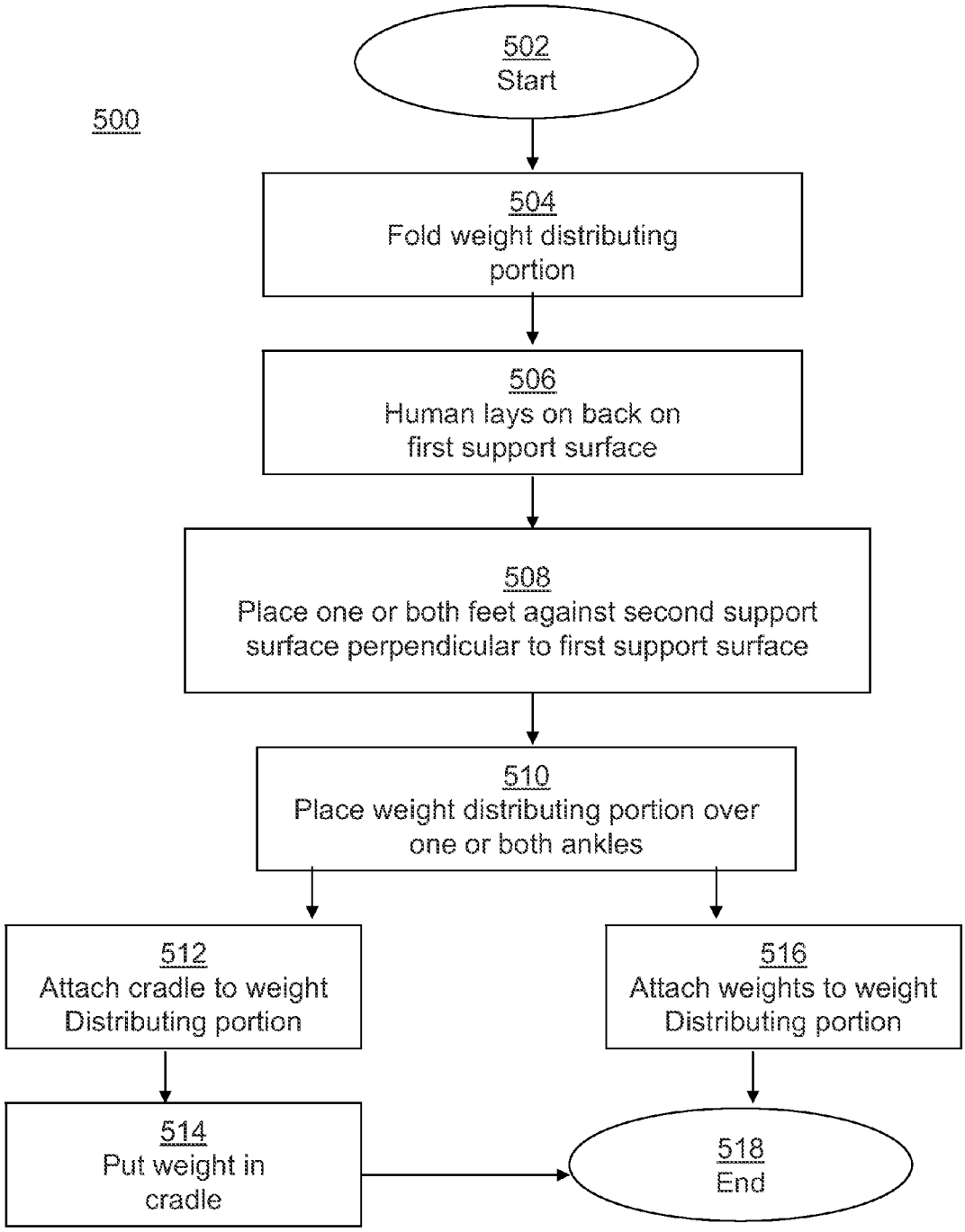
FIG. 15 is a flow chart of an exemplary method of bending a leg with a therapeutic device.

Referring now to FIGS. 9 and 15, a method 500 bending one or both legs 146 of a human with a therapeutic device 100 is depicted. Each one or both legs 146 includes an ankle 150 and a foot 166. The therapeutic device 100 includes a weight distributing portion 102 including a relief area 106, and a weight attaching portion 104 attached to the weight distributing portion 102.

The method 500 starts at step 502. The method 500 then proceeds to step 504.

At step 504, the weight distributing portion 102 is folded in half lengthwise. The method 500 then proceeds to step 506.

At step 506, a human lies on a first support surface 162, on their back. The method 500 then proceeds to step 508.

At step 508 one or both feet 166 are placed against a second support surface 164, the second support surface 164 substantially perpendicular to the first support surface 162, bending one or both legs 146.

At step 510, the weight distributing portion 102 is placed over one or both ankles 150. The straps 108 with loops 114 may hang over the sides of one or both ankles 150. The method 500 then proceeds to step 512 or step 516.

At step 512, a cradle 120 is attached to the weight distributing portion 102. In this method 500 embodiment, a correctly sized cradle 120, as would be known by someone skilled in the art may be used. The method 500 then proceeds to step 514.

At step 514, weight 110 may be put in the cradle 120. Weight 110 may include an object 142. The object 142 may include canned food, a bag of sugar or flour, a brick, a stone, a weight of some type, or any other object 142 with a weight that facilitates the correct stretch for a person.

The weight 110 may cause the weight distributing portion 102 to apply pressure pushing the one or both ankles 150 downward and bending one or both legs 146. The gentle pull of the weight 110 may draw the one or both feet 166 down the wall and thus may bend the one or both legs 146 at one or both knees 148. The method 500 then proceed to the end at step 518.

At step 516, weight 110 is attached to the weight distributing portion 102 with the weight attaching portion 104. In one example the weight attaching portion 104 includes straps 108 with loops 114. The straps 108 with loops 114 may extend down on both sides of the one or both ankles 150. A hand weight 112 may be placed in the loops 114. The size of the hand weight 112 may be selected to address each individual person's needs.

The weight 110 may cause the weight distributing portion 102 to apply downward pressure on the one or both ankles 150 which may bend the one or both legs 146 at one or both knees 148. The gentle pull of the weight 110 may draw the one or both feet 166 down the wall and thus may bend the one or both legs 146 at one or both knees 148. The method 500 then proceeds to the end at step 518.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A therapeutic device, comprising:

a weight distributing portion formed from a flexible flat material and including a relief area, the relief area having one of an aperture, a second material more flexible than the first material, or a puffed out section, and a weight attaching portion adapted to attach weights to the weight distributing portion, including straps adapted to hold one or more hand weights, the hand weights having an elongated section with two ends, and two end sections, each of the end sections attached to one of the ends of the elongated section.

2. The therapeutic device of claim 1, wherein the straps include at least two loops, the at least two loops spaced such that at least one loop holds the hand weight around the elongated section close to one end section, and at least one of the other loops holds the hand weight around the elongated section close to the other end section.

3. A therapeutic device, comprising:

a weight distributing portion formed from a flexible flat material and including a relief area, the relief area having one of an aperture, a second material more flexible than the first material, or a puffed out section, and a weight attaching portion adapted to attach weights to the weight distributing portion, including a cradle adapted to hold weights.

4. A therapeutic device, comprising:

a weight distributing portion formed from a flexible flat material and including a relief area, the relief area having one of an aperture, a second material more flexible than the first material, or a puffed out section, and a weight attaching portion adapted to attach weights to the weight distributing portion, including straps adapted to attach to a cradle adapted to hold weights.

5. The therapeutic device of claim 1, wherein the weight distributing portion is a substantially rectangular shape having a width and a length, and wherein the width is at least one fourth of the length.

6. The therapeutic device of claim 1, wherein the weight distributing portion is adapted to drape over a human leg including a knee, with the relief area over the knee.

7. The therapeutic device of claim 6, further including weights attached to the weight attaching portion, and wherein the weights cause pressure to be applied above and below the knee by the weight distributing portion; causing the leg to at least partially straighten.

8. The therapeutic device of claim 1, wherein the relief area includes an aperture.

9. The therapeutic device of claim 8, wherein the aperture includes an oval shape adapted to fit around a human knee.

10. The therapeutic device of claim 3, wherein the weight distributing portion is a substantially rectangular shape having a width and a length, and wherein the width is at least one fourth of the length.

11. The therapeutic device of claim 3, wherein the weight distributing portion is adapted to drape over a human leg including a knee, with the relief area over the knee.

12. The therapeutic device of claim 11, further including weights attached to the weight attaching portion, and wherein the weights cause pressure to be applied above and below the knee by the weight distributing portion; causing the leg to at least partially straighten.

13. The therapeutic device of claim 3, wherein the relief area includes an aperture.

14. The therapeutic device of claim 13, wherein the aperture includes an oval shape adapted to fit around a human knee.

15. The therapeutic device of claim 4, wherein the weight distributing portion is a substantially rectangular shape having a width and a length, and wherein the width is at least one fourth of the length.

16. The therapeutic device of claim 4, wherein the weight distributing portion is adapted to drape over a human leg including a knee, with the relief area over the knee.

17. The therapeutic device of claim 16, further including weights attached to the weight attaching portion, and wherein the weights cause pressure to be applied above and below the knee by the weight distributing portion; causing the leg to at least partially straighten.

18. The therapeutic device of claim 4, wherein the relief area includes an aperture.

19. The therapeutic device of claim 18, wherein the aperture includes an oval shape adapted to fit around a human knee.

* * * * *